United States Patent [19]

Vermeulen

[11] 3,952,977

[45] Apr. 27, 1976

[54] ELECTRICAL DETECTIVE CIRCUITS

[75] Inventor: Dirk J. Vermeulen, Johannesburg, South Africa

[73] Assignee: Western Industries (Proprietary) Limited, Johannesburg, South Africa

[22] Filed: Sept. 23, 1974

[21] Appl. No.: 508,167

[30] Foreign Application Priority Data

June 11, 1974 South Africa ..... 74/3701

[52] U.S. Cl. ..... 246/37; 246/34 R; 246/114 A

[51] Int. Cl.[2] ..... B61L 23/16

[58] Field of Search ..... 246/34 CT, 34 R, 37, 246/131, 132, 133, 134, 112, 113, 114 R, 114 A, 115

[56] References Cited

UNITED STATES PATENTS

| | | | |
|---|---|---|---|
| 3,345,512 | 10/1967 | Failor | 246/37 |
| 3,524,054 | 8/1970 | Smith | 246/114 R |
| 3,819,933 | 6/1974 | Grundy | 246/114 A |

*Primary Examiner*—Duane A. Reger
*Assistant Examiner*—Reinhard J. Eisenzopf
*Attorney, Agent, or Firm*—Berman, Aisenberg & Platt

[57] ABSTRACT

A detective circuit for railway points composed of three track sections connected together at a junction or for a railway crossing composed of four track sections connected together at a junction. The circuit comprises an ac generator adapted to supply energy at a selected frequency across the junction of the points or crossing, a first capacitor connected across the junction to form a tuned circuit at the said frequency with the inductance of first lengths of track between the junction and the intersection or intersections of the tracks, a low impedance, frequency selective link connected across the tracks of each section of the points or crossing, each link comprising a second capacitor forming a tuned circuit at the said frequency with the inductance of an inductor connected in series therewith, characterised in that the detective circuit includes a third capacitor connected across the tracks of each section of the points or crossing at a position spaced from the link on the side thereof nearest the points or crossing junction, and means for monitoring the voltage across each third capacitor, each third capacitor forming a tuned circuit at the said frequency with the inductance of second lengths of track between the third capacitor and the appropriate link, the tuned circuits formed by said second and third capacitors in the converging track section operating as a result of the voltage arising in the aforesaid first lengths of track during use of the detective circuit.

5 Claims, 3 Drawing Figures

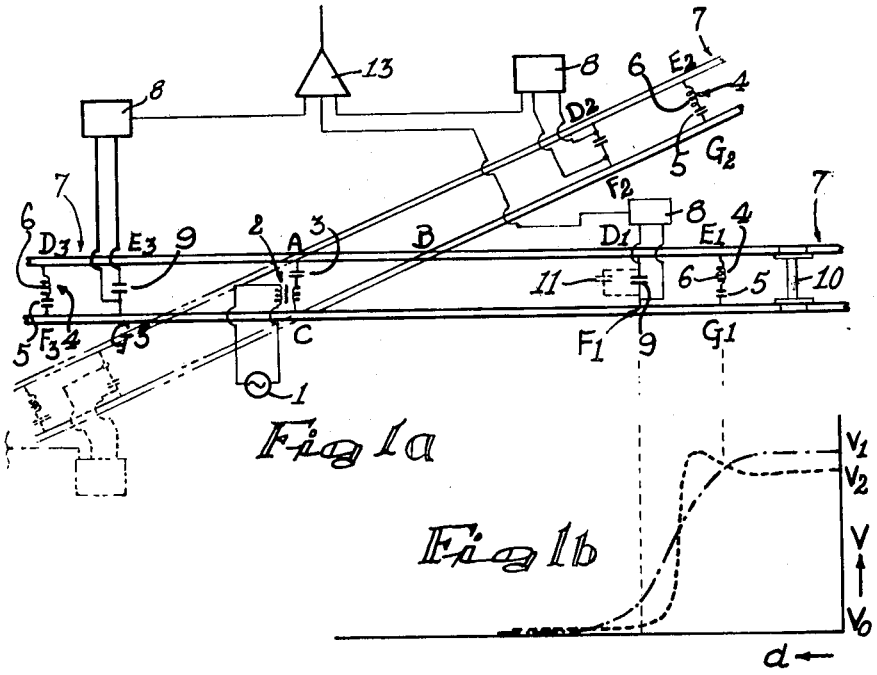
Fig 1a
Fig 1b
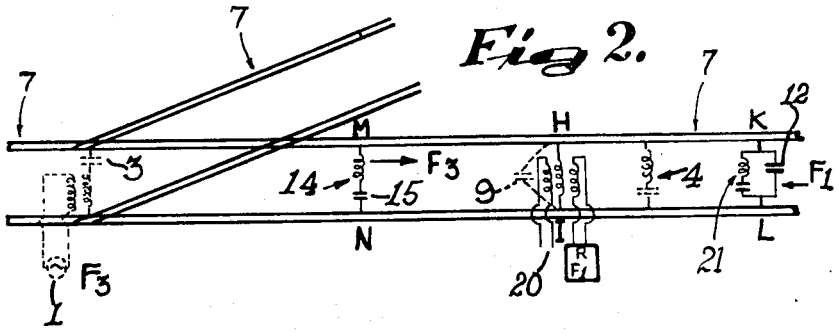
Fig 2.

ELECTRICAL DETECTIVE CIRCUITS

BACKGROUND OF THE INVENTION

This invention relates to electrical detective circuits for railway points and crossings.

It has been proposed to provide an ac generator to supply energy across a points or crossings junction. A capacitor is connected across the junction to form a tuned circuit, at the generator frequency, with the inductance of the lengths of track between the junction and the intersection of the tracks.

The resultant voltage arising in these lengths of track is used to supply second circuits located in the converging entries of the points or crossing. Each second circuit comprises a short circuit across the tracks and a second capacitor connected across the tracks at a position between the short circuit and the points or crossing. The second capacitor forms a tuned circuit at the generator frequency with the inductance of the short circuit and of the lengths of track between the short circuit and the second capacitor.

When a train axle passes the short circuit the axle shunts the second circuit and its tuning is disturbed. This provides a means of detecting the presence of the axle.

The circuit described above suffers from the disadvantage that it cannot be overlapped with a jointless track circuit such as the "Aster" track circuit. The reason for this is that the short circuit described above will impose a non-detective zone between the points or crossing circuit and the jointless track circuit.

To overcome the above disadvantage, it has been proposed to replace the short circuit and capacitor with a frequency selective low impedance link across the tracks. The link comprises a capacitor forming a tuned circuit with the inductance of an inductor connected in series therewith. The disadvantage of this arrangement is that an axle passing through the entry only gradually shunts the tuned link circuit with the result that an axle, particularly if it only provides a high resistance shunt, can be some distance from the link before it is detected.

BRIEF SUMMARY OF THE INVENTION

It is an object of the present invention to provide a detective circuit which can be made to react more sharply to a shunt than the circuits above described and which can be overlapped with suitable jointless track circuits.

According to this invention there is provided a detective circuit for railway points composed of three track sections connected together at a junction or for a railway crossing composed of four track sections connected together at a junction, said circuit comprising:

an ac generator adapted to supply energy at a selected frequency across the junction of the points or crossing, a first capacitor connected across the junction to form a tuned circuit at the said frequency with the inductance of first lengths of track between the junction and the intersection or intersections of the tracks, a low impedance frequency selective link connected across the tracks of each section of the points or crossing, each link comprising a second capacitor forming a tuned circuit at the said frequency with the inductance of an inductor connected in series therewith, characterised in that the detective circuit includes a third capacitor connected across the tracks of each section of the points or crossing at a position spaced from the link on the side thereof nearest the points or crossing junction, and, means for monitoring the voltage across each third capacitor, each third capacitor forming a tuned circuit at the said frequency with the inductance of second lengths of track between the third capacitor and the appropriate link, the tuned circuits formed by said second and third capacitors in the converging track sections of the points or crossing operating as a result of the voltage arising in the aforesaid first lengths of track during use of the detective circuit.

Further features of the invention provide for the value of the capacitance of each third capacitor to be increased above the value required to form the tuned circuit at the said frequency with the inductance of the said second lengths of track, for the generator to be connected to a transformer of which a winding is connected across the junction, the first capacitor being connected in series with said winding, the first capacitor forming a tuned circuit with the inductance of the first lengths of track and of the winding and, for the means for monitoring the voltage across each third capacitor to be receivers, one connected across each third capacitor and a device connected to each receiver to receive signals therefrom, the device forming an AND gate.

The invention also provides for the link and third capacitor in one or more track sections of the points or crossing to be overlapped with a jointless track circuit adapted to monitor vehicle presence on the track leading to the relevant track section.

BRIEF DESCRIPTION OF THE DRAWINGS

FIG. 1*a* illustrates a detective circuit in accordance with the invention,

FIG. 1*b* is a voltage diagram, and

FIG. 2 illustrates the detective circuit of FIG. 1 overlapped with a jointless track circuit.

DETAILED DESCRIPTION OF PREPARED EMBODIMENTS OF THE INVENTION

Referring to FIG. 1, there is shown a set of railway points composed of three track sections 7 connected together at a junction AC. An ac generator 1 is connected to the primary winding of a transformer 2 of which the secondary winding is connected across the junction AC.

A first capacitor 3 is connected in series with the secondary winding to form a tuned circuit, at the generator frequency, with the inductance of first lengths of track AB and CB between the junction and the intersection of the track and with the inductance of the secondary winding. The voltage arising in the lengths of track AB and CB is used to power detective circuits in the two converging sections of the points. The voltage developed across the junction AC is used directly to power the detective circuit in the remaining section of the points.

The detective circuits in the track sections comprise a low impedance, frequency selective link 4 across the tracks of each section. Each link comprises a second capacitor 5 forming a tuned circuit at the generator frequency with the inductance of an inductor 6 connected in series therewith.

A third capacitor 9 is connected across the tracks of each entry at a predetermined position spaced from each link 4 on the side thereof nearest the junction AC.

Means are provided for monitoring the voltage across each third capacitor 9 comprising receivers 8, one connected across each capacitor. Each receiver is connected to a receiving device 13 forming an AND gate. Should the signal from any one receiver 8 diminish by a predetermined amount, the output of the receiving device 13 will consequently diminish or disappear and a suitable relay will be de-energised.

In one form of the invention, each capacitor 9 forms a tuned circuit, at the generator frequency, with the inductance of the lengths of track DE and FG between the capacitor and the appropriate link 4.

In use, the receiver voltage derived from each capacitor 9 remains constant at a value of say V1. When a wheel axle 10 crosses a link 4 the voltage V1 drops rapidly to Vo as shown in FIG. 1*b*. The voltage drop is due firstly to the disturbance caused by the axle in the tuned circuit formed by the capacitor 9 and is due, secondly to the shunting by the axle of the receiver input. Detection of a wheel axle can therefore take place in the relatively short length of track between a link 4 and capacitor 9.

In a preferred form of the invention, the capacitance of each third capacitor 9 is increased above the value required to form the tuned circuit described. This may be achieved by connecting a capacitor 11 in parallel with the capacitor 9 as shown in dotted lines in FIG. 1. It will be understood that the circuit formed by capacitor 9, link 4 and the lengths of track DE and FG will now be out of tune. However, the increased capacitance of capacitor 9 is so chosen that the circuit is still reasonably tuned so as to provide a receiver voltage of say V2. Thus, when an axle 10 crosses the link 4, the axle serves firstly to bring the circuit described into tune. This is shown by the increase in voltage V2 in FIG. 1*b*. Thereafter the axle serves to drop the voltage more rapidly than in the case described above, as shown in FIG. 1*b*.

In the preferred form of the invention described above, the detective circuit in any track section therefore reacts sharply to a shunt and detection occurs over a shorter length of track than in the previous case described.

In FIG. 2 the detective circuit described above is shown overlapped with an "Aster" jointless track circuit. The latter is known in the art and will not be described in great detail. A capacitor 12 forms a tuned circuit, at a frequency F1 of a signal received along the track, with the inductance of an inductor H1 and the inductance of the lengths of track HK and IL. A series tuned link 14 blocks transmission of signal F1 beyond that link.

When an axle shunts the tuned circuit described above, it is detected by the resultant fall-off of voltage in a receiver RF1.

The detective circuit according to the invention, operating at a frequency F3, is shown in dotted lines in FIG. 2, the link 4 being located to the right of the inductor HI in the drawing. The frequencies F1 and F3 are chosen at sufficiently different values to allow the two detective circuits to operate reasonably unaffected by one another. It will readily be appreciated that the above arrangement has no non-detective zone and that an axle placed anywhere along the track section will be detected by either or both the detective circuits described above.

The Aster track circuit usually has a filter 21 and a generator at winding 20 to supply a signal to another tuned circuit further down the track. No such filter and generator are required in the present embodiment. The winding 20 may therefore be utilised to couple the receiver for monitoring the voltage across the capacitor 9 of the points track circuit. The capacitor 9 will therefore be connected across the tracks at a point close to the winding 20 as shown in FIG. 3.

It will be understood that the circuits applied to railway points as described above may equally well be applied to railway crossings. Such circuits would be the same as those described above and would also be included in the fourth set of track branches shown in chain-dotted lines in FIG. 1.

What I claim as new and desire to secure by Letters Patent is:

1. A detective circuit for railway points composed of three track sections connected together at a junction or for a railway crossing composed of four track sections connected together at a junction, said circuit comprising:

an ac generator means for supplying energy at a selected frequency across the junction of the points or crossing, a first capacitor connected across the junction to form a tuned circuit at the said frequency with the inductance of first lengths of track between the junction and the intersection or intersections of the tracks, a low impedance frequency selective link connected across the tracks of each section of the points or crossing, each link comprising a second capacitor forming a tuned circuit at the said frequency with the inductance of an inductor connected in series therewith, characterised in that the detective circuit includes a third capacitor connected across the tracks of each section of the points or crossing at a position spaced from the link on the side thereof nearest the points or crossing junction, and, means for monitoring the voltage across each third capacitor, each third capacitor forming a tuned circuit at the said frequency with the inductance of second lengths of track between the third capacitor and the appropriate link, the tuned circuits formed by said second and third capacitors in the converging track section operating as a result of the voltage arising in the aforesaid first lengths of track during use of the detective circuit.

2. A circuit as claimed in claim 1 including means increasing the capitance of each third capacitor above the value required to form said resonant circuit at said frequency with the inductance of said second lengths of track.

3. A circuit as claimed in claim 1 in which said generator means is connected to a transformer of which a winding is connected across the junction, the first capacitor being connected in series with said winding, the first capacitor forming a resonant circuit with the inductance of said first lengths of track and of the winding.

4. A circuit as claimed in claim 1 in which the means for monitoring the voltage across each third capacitor comprise receivers, one connected across each third capacitor and a device connected to each receiver to receive signals therefrom, the device forming an AND gate.

5. A circuit as claimed in claim 1 in which the link and third capacitor in one or more track sections of the points or crossing are overlapped with a jointless track circuit means for monitoring vehicle presence on the track leading to the relevant track section.

* * * * *